US011341987B2

(12) United States Patent
Dehghani et al.

(10) Patent No.: US 11,341,987 B2
(45) Date of Patent: May 24, 2022

(54) COMPUTATIONALLY EFFICIENT SPEECH CLASSIFIER AND RELATED METHODS

(71) Applicant: SEMICONDUCTOR COMPONENTS INDUSTRIES, LLC, Phoenix, AZ (US)

(72) Inventors: Pejman Dehghani, Kingston (CA); Robert L. Brennan, Kitchener (CA)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 632 days.

(21) Appl. No.: 16/375,039

(22) Filed: Apr. 4, 2019

(65) Prior Publication Data

US 2019/0325899 A1 Oct. 24, 2019

Related U.S. Application Data

(60) Provisional application No. 62/659,937, filed on Apr. 19, 2018.

(51) Int. Cl.
*G10L 25/00* (2013.01)
*G10L 25/84* (2013.01)
(Continued)

(52) U.S. Cl.
CPC ..... *G10L 25/84* (2013.01); *G10L 21/0308* (2013.01); *G10L 25/21* (2013.01)

(58) Field of Classification Search
CPC . G10L 15/04; G10L 15/05; G10L 2015/0636; G10L 2015/0635; G10L 15/08;
(Continued)

(56) References Cited

U.S. PATENT DOCUMENTS 6,236,731 B1 5/2001 Brennan et al.
6,240,192 B1 5/2001 Brennan et al.
(Continued)

OTHER PUBLICATIONS

G. Evangelopoulos and P. Maragos, "Multiband Modulation Energy Tracking for Noisy Speech Detection," in IEEE Transactions on Audio, Speech, and Language Processing, vol. 14, No. 6, pp. 2024-2038, Nov. 2006, doi: 10.1109/TASL.2006.872625. (Year: 2006).*

(Continued)

*Primary Examiner* — Edgar X Guerra-Erazo
(74) *Attorney, Agent, or Firm* — Brake Hughes Bellermann LLP

(57) ABSTRACT

In a general aspect, an apparatus for detecting speech can include a signal conditioning stage that receives a signal corresponding with acoustic energy, filters the received signal to produce a speech-band signal, calculates a first sequence of energy values for the received signal and calculates a second sequence of energy values for the speech-band signal. The apparatus can also include a detection stage including a plurality of speech and noise differentiators. The detection stage can being configured to receive the first and second sequences of energy values and, based on the first sequence of energy values and the second sequence of energy values, provide, for each speech and noise differentiator of the plurality of speech and noise differentiators, a respective speech-detection indication signal. The apparatus can also include a combination stage configured to combine the respective speech-detection indication signals and based on the combination of the respective speech-detection indication signals, provide an indication of one of presence of speech in the received signal and absence of speech in the received signal.

25 Claims, 8 Drawing Sheets

(51) Int. Cl.
*G10L 21/0308* (2013.01)
*G10L 25/21* (2013.01)

(58) Field of Classification Search
CPC ..... G10L 15/083; G10L 15/10; G10L 15/16; G10L 15/20; G10L 17/02; G10L 17/08; G10L 17/10; G10L 19/005; G10L 19/012; G10L 19/008; G10L 19/02; G10L 19/0204; G10L 19/0208; G10L 19/0212; G10L 19/0216; G10L 19/022; G10L 19/025; G10L 19/028; G10L 19/03; G10L 19/06; G10L 19/07; G10L 19/08; G10L 19/083; G10L 19/087; G10L 19/09; G10L 19/093; G10L 19/097; G10L 19/12; G10L 19/10; G10L 19/26; G10L 19/265; G10L 21/00; G10L 21/003; G10L 21/007; G10L 21/01; G10L 21/02; G10L 21/0208; G10L 2021/02082; G10L 2021/02085; G10L 2021/02087; G10L 21/0216; G10L 2021/02161; G10L 2021/02163; G10L 2021/02165; G10L 2021/02166; G10L 2021/02168; G10L 21/0224; G10L 21/0232; G10L 21/0264; G10L 21/0272; G10L 21/028; G10L 21/0308; G10L 21/0364; G10L 21/0324; G10L 21/0332; G10L 21/034; G10L 21/038; G10L 21/0388; G10L 21/04; G10L 21/057; G10L 25/00; G10L 25/21; G10L 25/24; G10L 25/18; G10L 25/15; G10L 25/12; G10L 25/06; G10L 25/09; G10L 25/03; G10L 25/30; G10L 25/45; G10L 25/51; G10L 25/69; G10L 25/72; G10L 25/78; G10L 2025/783; G10L 2025/786; G10L 25/81; G10L 25/84; G10L 25/87; G10L 2025/906; G10L 25/90; G10L 25/93; G10L 2025/932; G10L 2025/937; G10L 2025/935
See application file for complete search history.

(56) References Cited

U.S. PATENT DOCUMENTS

| | | | | |
|---|---|---|---|---|
| 10,115,399 | B2 * | 10/2018 | Lepauloux | G10L 25/84 |
| 2005/0096898 | A1 | 5/2005 | Singhal | |
| 2009/0254340 | A1 * | 10/2009 | Sun | G10L 21/0208 704/226 |
| 2011/0264447 | A1 | 10/2011 | Visser et al. | |
| 2014/0358552 | A1 * | 12/2014 | Xu | G06F 1/3215 704/275 |
| 2018/0025732 | A1 * | 1/2018 | Lepauloux | G10L 25/81 704/210 |

OTHER PUBLICATIONS

Yao, Rui et al. "A priori SNR estimation and noise estimation for speech enhancement." EURASIP journal on advances in signal processing vol. 2016,1 (2016): 101. doi:10.1186/s13634-016-0398-z (Year: 2016).*

S. Morita, X. Lu and M. Unoki, "Signal to noise ratio estimation based on an optimal design of subband voice activity detection," The 9th International Symposium on Chinese Spoken Language Processing, 2014, pp. 560-564, doi: 10.1109/ISCSLP.2014.6936717. (Year: 2014).*

* cited by examiner

COMPUTATIONALLY EFFICIENT SPEECH CLASSIFIER AND RELATED METHODS

CROSS REFERENCE TO RELATED APPLICATION

This application claims priority to and the benefit of U.S. Provisional Application No. 62/659,937, filed Apr. 19, 2018, entitled "A ROBUST SPEECH CLASSIFIER IN ULTRA-LOW PROCESSING POWER SETTING", which is hereby incorporated by reference in its entirety.

TECHNICAL FIELD

This description relates to apparatus for speech detection (e.g., speech classification) and related methods for speech detection. More specifically, this description relates to apparatus and related methods for detecting presence or absence of speech in applications with limited computational processing power, such as, for example, in hearing aids.

BACKGROUND

Speech detection has been of great interest, with numerous applications in audio signal processing fields, and many advances in speech detection have been made over recent years. Specifically, advancements in computational (processing) capabilities and internet connectivity have enabled techniques providing accurate speech detection on many devices. However, such approaches are computationally infeasible in many low (ultra-low) power applications (e.g., applications with limited processing power, battery power, etc.). For example, in hearing aid applications, where long lasting battery life is of upmost importance and cloud based processing is not yet practical due to latency restrictions, current approaches are impractical. Given such drawbacks, implementing a speech classifier (speech detector) that performs accurately and efficiently, with minimal computational and/or resources is challenging.

SUMMARY

In a general aspect, an apparatus for detecting speech can include a signal conditioning stage configured to receive a signal corresponding with acoustic energy in a first frequency bandwidth, filter the received signal to produce a speech-band signal, the speech-band signal corresponding with acoustic energy in a second frequency bandwidth, the second frequency bandwidth being a first subset of the first frequency bandwidth, calculate a first sequence of energy values for the received signal, and calculate a second sequence of energy values for the speech-band signal. The apparatus can also include, a detection stage including a plurality of speech and noise differentiators. The detection stage can being configured to receive the first sequence of energy values and the second sequence of energy values and, based on the first sequence of energy values and the second sequence of energy values, provide, for each speech and noise differentiator of the plurality of speech and noise differentiators, a respective speech-detection indication signal. The apparatus can still further include a combination stage configured to combine the respective speech-detection indication signals and, based on the combination of the respective speech-detection indication signals, provide an indication of one of presence of speech in the received signal and absence of speech in the received signal.

In another general aspect, an apparatus for speech detection can include a signal conditioning stage configured to receive a digitally sampled audio signal, calculate a first sequence of energy values for the digitally sampled audio signal, and calculate a second sequence of energy values for the digitally sampled audio signal. The second sequence of energy values can correspond with a speech-band of the digitally sampled audio signal. The apparatus can also include a detection stage. The detection stage can include a modulation-based speech and noise differentiator configured to provide a first speech-detection indication based on temporal modulation activity in the speech-band. The detection stage can also include a frequency-based speech and noise differentiator configured to provide a second speech-detection indication based on a comparison of the first sequence of energy values with the second sequence of energy values. The detection stage can further include an impulse detector configured to provide a third speech-detection indication based on a first order differentiation of the digitally sampled audio signal. The apparatus can also include a combination stage configured to combine the first speech-detection indication, the second speech-detection indication and the third speech-detection indication and, based on the combination of the first speech detection indication, the second speech detection indication and the third speech-detection indication, provide an indication of one of a presence of speech in the digitally sampled audio signal and an absence of speech in the digitally sampled audio signal.

In another general aspect, a method for speech detection can include receiving, by an audio processing circuit, a signal corresponding with acoustic energy in a first frequency bandwidth, filtering the received signal to produce a speech-band signal, the speech-band signal corresponding with acoustic energy in a second frequency bandwidth. The second frequency bandwidth can be a subset of the first frequency bandwidth. The method can further include calculating a first sequence of energy values for the received signal, and calculating a second sequence of energy values for the speech-band signal. The method can also include receiving, by a detection stage including a plurality of speech and noise differentiators, the first sequence of energy values and the second sequence of energy values, and based on the first sequence of energy values and the second sequence of energy values, providing, for each speech and noise differentiator of the plurality of speech and noise differentiators, a respective speech-detection indication signal. The method can still further include, combining, by a combination stage, the respective speech-detection indication signals and, based on the combination of the respective speech-detection indication signals, providing an indication of one of presence of speech in the received signal and absence of speech in the received signal.

BRIEF DESCRIPTION OF THE DRAWINGS

Like reference symbols in the various drawings indicate like and/or similar elements.

DETAILED DESCRIPTION

This disclosure is directed to apparatus (and related methods) for speech classification (e.g., speech detection). As discussed herein, speech classification (speech detection) refers to identifying speech content of interest in an audio signal that may include other (e.g., unwanted) audio content such as noise, such as white noise, pink noise, babble noise, impulsive noise, and so forth. White noise can be noise with equal energy (acoustic energy) per frequency, pink noise can be noise with equal energy per octave, babble noise can be two or more people speaking (in the background), and impulsive noise can be short duration noise that can include acoustic energy that mimics desired speech content, such as a hammer hitting a nail, a door shutting, dishes clattering, etc. Impulsive noises can be of short duration, repetitive, loud and/or can include post-noise ringing. A goal of speech classification is to identify audio signals that include desired speech content (e.g., a person speaking directly another person wearing a hearing aid), even in the presence of noise content in an audio signal that includes the desired speech content. For purposes of this disclosure, the term "speech" generally refers to desired speech content in an audio signal, and "speech classification" refers to identifying whether or not an audio signal includes speech.

The implementations described herein can be used to implement computationally efficient and power efficient speech classifier (and associated methods). This can be accomplished based on the particular arrangements of speech and noise differentiators (detectors) included in the example implementations, as well using computationally efficient approaches for determining a speech classification for an audio signal, such as those described herein.

In the example implementations described herein, various operating parameters and techniques, such as thresholds, coefficients, calculations, sampling rates, frame rates, frequency ranges (frequency bandwidths) etc. are described. These example operating parameters and techniques are given by way of example, and the specific operating parameters, operating parameter values and techniques (e.g., computation approaches, etc.) used will depend on the particular implementation. Further, various approaches for determining the specific operating parameters and techniques for a given implementation can be determined in a number of ways, such as using empirical measurements and data, using training data, and so forth.

Figure 1A:
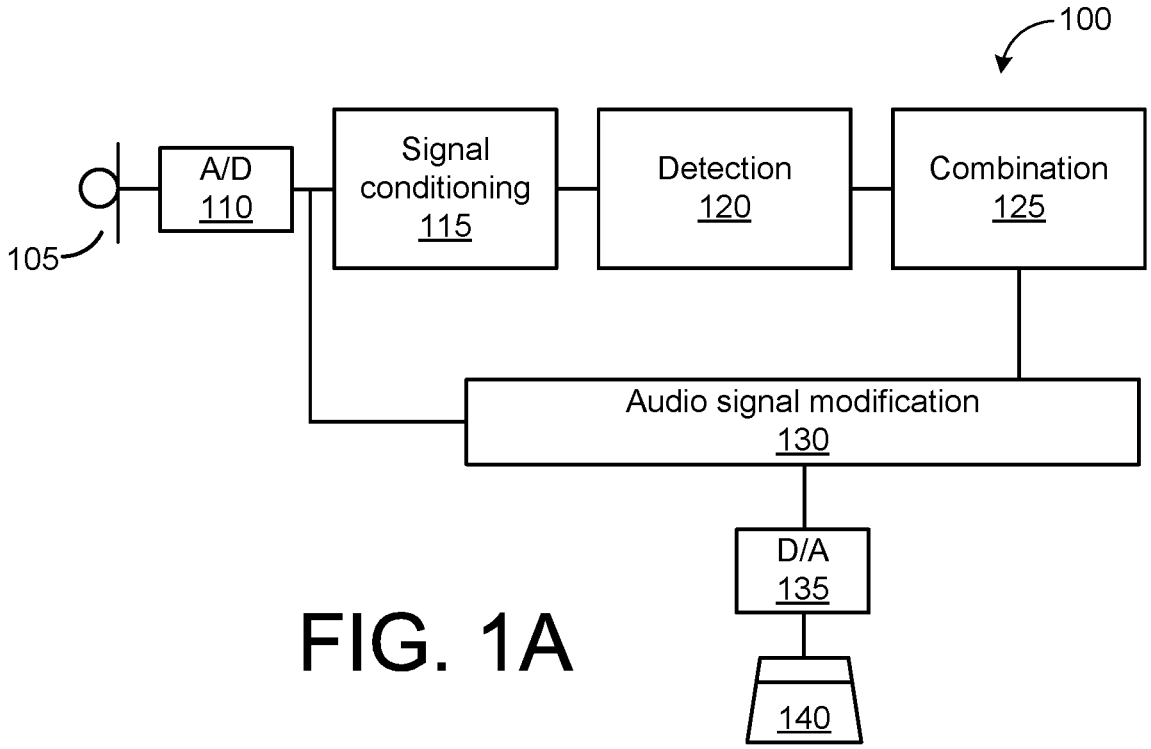
FIG. 1A is a block diagram illustrating an apparatus implementing a speech classifier.

FIG. 1A is a block diagram illustrating an apparatus 100 that implements speech classification. As shown in FIG. 1A, the apparatus 100 includes a microphone 105, an analog-to-digital (A/D) converter 110, a signal conditioning stage 115, a detection stage (e.g., speech and noise differentiation stage) 120, a combination stage (e.g., a statistics gathering and combination stage) 125, an audio signal modification stage 130, a digital-to-analog converter 135, and an audio output device (e.g., a speaker) 140. In the apparatus 100, a speech classifier can include the signal conditioning stage 115, the detection stage 120 and the combination stage 125.

The microphone 105 (e.g., a transducer of the microphone 105) can provide an analog voltage signal corresponding with acoustic energy received at the microphone 105. That is, the microphone can transform physical sound wave pressures to respective equivalent voltage representations for acoustic energy across an audible frequency range (e.g. a first frequency range). The A/D converter 110 can receive the analog voltage signal from the microphone and convert the analog voltage signal to a digital representation of the analog voltage signal (e.g., a digital signal).

The signal conditioning stage 115 can receive the digital signal (e.g., a received signal) and, based on the received (digital) signal, generate a plurality of inputs for the detection stage 120. For example, the received signal can be processed through a bandpass filter (not shown in FIG. 1A) using a frequency passband (e.g., a second frequency range) that corresponds with a portion of the received signal where speech energy is dominant speech energy regions, where the frequency range of the passband is a subset of frequencies included in the received signal. The signal conditioning stage 120 can then calculate respective sequences (e.g., first and second sequences) of energy values for the received (digital) signal and the bandpass filtered signal. The first and second sequences of energy values can be passed by the signal conditional stage 115 as inputs to the detection stage 120, which can perform speech and noise differentiation and/or detection based on the received input signals.

In some implementations, the detection stage 120 can include a plurality of speech and noise differentiators, such as those described herein. For example, the detection stage 120 can be configured to receive the first sequence of energy values and the second sequence of energy values from the signal conditioning stage 115 and, based on the first sequence of energy values and the second sequence of energy values, provide, for each speech and noise differentiator of the plurality of speech and noise differentiators, a respective speech-detection indication signal to the combination stage 125. Depending on the particular implementation (e.g., the particular detector), a respective speech-detection indication signal can indicate that speech may be present, indicate speech-may not be present, or indicate that a specific type of noise may be present (e.g., an impulsive noise).

In some implementations, the combination stage 125 can be configured to combine the respective speech-detection indication signals from the detection stage 120 (e.g., gather statistics on respective speech-detection indication signals, and combine those gathered statistics) to indicate presence or absence of speech in the received signal. That is, based on the combination of the respective speech-detection indication signals, the combination stage 125 can provide an indication of one of presence of speech in the received signal and absence of speech in the received signal. Based on the indication (e.g., speech or no speech) provided by the combination stage 125, the audio signal modification stage 130 can then perform audio processing on the received (digital) signal (e.g., to remove noise, enhance speech, discard the received signal, and so forth). The audio signal modification stage 130 can provide the processed signal to the D/A converter 135, and the D/A converter 135 can convert the processed signal to an analog (voltage) signal for playback on the audio output device 140.

In some implementations, as is discussed further below, combining the respective speech-detection indication signals (from the detection stage 120) by the combination stage 125 can include maintaining a weighted rolling counter value between a lower limit and an upper limit, where the weighted rolling counter value can be based on the respective speech-detection indication signals. The combination stage 125 can be configured to indicate the presence of speech in the received signal if the weighted rolling counter value is above a threshold value; and indicate the absence of speech in the received signal if the weighted rolling counter value is below the threshold value. As noted above, an example of such an implementation is discussed in further detail below with respect to, at least, FIG. 3.

Figure 1B:
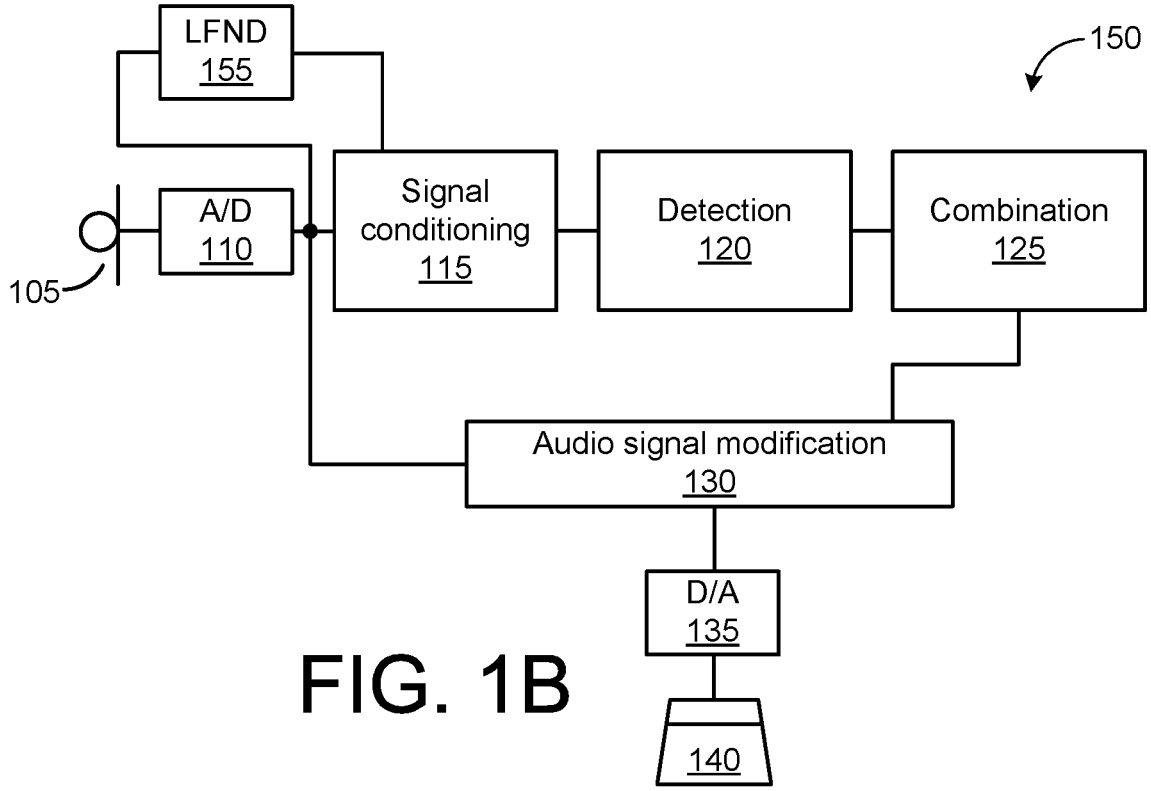
FIG. 1B is a block diagram illustrating another apparatus implementing a speech classifier.

FIG. 1B is a block diagram illustrating another apparatus 150 that implements speech classification. The apparatus 150 illustrated in FIG. 1B is similar to the apparatus 100 shown in FIG. 1A, but further includes a low-frequency noise detector (LFND) 155. Accordingly, the discussion of FIG. 1A above can also apply to FIG. 1B and, for purposes of brevity, the details of that discussion are not repeated here.

In this example, the LFND 155 can be configured to detect the presence of low-frequency and/or ultra-low frequency noise (such as vehicle noise that may be present in a car, airplane, train, etc.) in a received (digital) audio signal. In some implementations, the LFND 155, in response to detecting a threshold level of low-frequency and/or ultra-low frequency noise, the LFND 155 can, via signal (a feedback signal), instruct the signal conditioning stage to change (update) its passband frequency range (e.g., speech-band) to a higher frequency range (e.g., a third frequency range), to reduce the effects of the detected low-frequency noise on speech classification. Example implementations of an LFND (e.g., that can be used to implement the LFND 155) are discussed in further detail below.

Briefly, however, in some implementations, continuing with the example of FIG. 1A, the LFND 155 can be configured to determine, based on the received (digital) signal, an amount of low-frequency noise energy in the acoustic energy in the first frequency bandwidth. The LFND 155 can be further configured, if the determined amount of low-frequency noise energy is above a threshold, to provide a feedback signal to the signal conditioning stage 115. As noted above, the signal conditioning stage 115 can be configured to, in response to the feedback signal, change the second frequency bandwidth to a third frequency bandwidth. The third frequency bandwidth can be a second subset of the first frequency bandwidth and include higher frequencies than the second frequency bandwidth, as was discussed above.

In some implementations, the LFND 155 can be further configured to determine, based on the received signal, that the amount of low-frequency noise energy in the acoustic energy over the first frequency bandwidth has decreased from being above the threshold to being below the threshold, and change the feedback signal to indicate that the amount of low-frequency noise energy in the acoustic energy over the first frequency bandwidth is below the threshold. The signal conditioning stage 115 can be further configured to, in response to the change in the feedback signal, change the third frequency bandwidth to the second frequency bandwidth.

Figure 2:
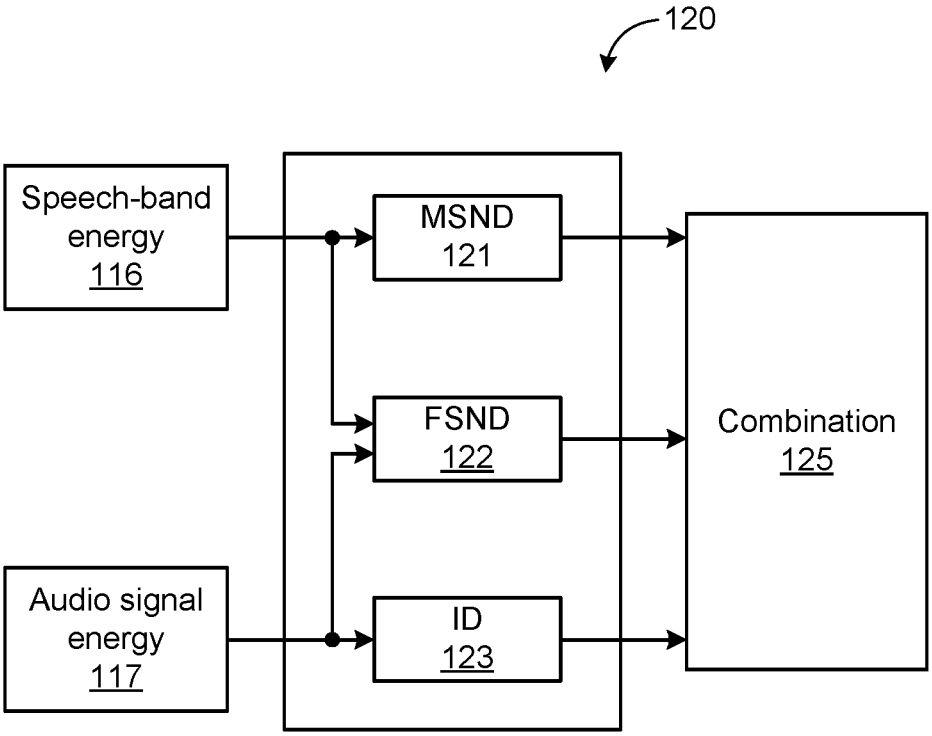
FIG. 2 is a block diagram illustrating an implementation of a portion of a speech classifier that can be implemented in conjunction with the apparatus of FIGS. 1A and 1B.

FIG. 2 is a block diagram illustrating an implementation of a portion of a speech classifier (detector) apparatus that can be implemented in conjunction with the apparatus of FIGS. 1A and 1B. In some implementations, the arrangement shown in FIG. 2 can be implemented in other apparatus used for speech classification and/or audio signal processing. For purposes of illustration, the arrangement shown in FIG. 2 will be further described with reference to FIG. 1A and the foregoing discussion of FIG. 1A.

As shown in FIG. 2, the detection stage 120 can include a modulation-based speech and noise differentiator (MSND) 121, a frequency-based speech and noise differentiator (FSND) and an impulse detector (ID) 123. In other implementations, other arrangements are possible. The detection stage 120 can receive (e.g., from the signal conditioning stage 115) a sequence of energy values 116 based on the speech and a sequence of energy values 117 based on the received signal (e.g., a digital representation of a microphone signal).

In some implementations, the MSND 121 can be configured to provide a first speech-detection indication (e.g., to the combination stage 125) based on temporal modulation activity in a selected speech-band (e.g., the second frequency bandwidth or the third frequency bandwidth discussed with respect to FIG. 1A). For instance, the MSND 121 can be configured to differentiate speech from noise based on their respective temporal modulation activity level. The MSND 121, when properly configured (e.g., based on empirical measurements, etc.) can differentiate noise with slowly varying energy fluctuations (such as room ambient noise, air-conditioning/HVAC noise) from speech, which has higher energy fluctuations than most noise signals. Additionally, when properly configured, the MSND 121 can also provide immunity (e.g., prevent incorrect speech classifications) from noise with temporal modulation characteristics, such as babble noise, that are closer to that of speech.

In some implementations, the MSND 121 can be configured to differentiate speech from noise by: calculating a speech energy estimate for the speech-band signal based on the second sequence of energy values; calculating a noise energy estimate for the speech-band signal based on the second sequence of energy values; and providing its respective speech-detection indication based on a comparison of the speech energy estimate with the noise energy estimate. The speech energy estimate can be calculated over a first time period, and the noise energy estimate can be calculated over a second time period, the second time period being greater than the first time period. Examples of such implementations are discussed in further detail below.

In some implementations, the FSND 122 can be configured to provide a second speech-detection indication (e.g., to the combination stage 125) based on a comparison of the first sequence of energy values with the second sequence of energy values (e.g., compare energy in the speech band with energy of the received signal). In some implementations, the FSND 122 can differentiate speech from noise by identifying noise as those audio signal energies that do not have expected frequency contents of speech. Based on empirical studies, the FSND 122 can be effective in identifying and rejecting out-of-band noise (e.g., outside a selected speech-band), such as, at least a portion of, noise produced by a set of jingling keys, vehicle noise, etc.

In some implementations, the FSND 122 can be configured to identify and reject out-of-band noise by comparing the first sequence of energy values with the second sequence of energy values, and providing the second speech-detection indication based on the comparison. That is, the FSND 122 can compare energy in the selected speech-band with energy of the entire received (digital) signal (e.g., over a same time period) to identify and reject out-of-band audio content in the received signal. In some implementations, the FSND 122 can compare the first sequence of energy values with the second sequence of energy values by determining a ratio between energy values of the first sequence of energy values and corresponding (e.g., temporally corresponding) energy values of the second sequence of energy values.

In some implementations, the ID 123 can be configured to provide a third speech-detection indication based on a first order differentiation of the digitally sampled audio signal. In some implementations, the ID 123 can identify impulsive noise that the MSND 121 and FSND 122 may incorrectly identify as speech. For instance, in some implementations, the ID 123 can be configured to identify noise signals, such as can occur in factory, or other environments where repetitive impulse-type sounds, like nail hammering, occur. In some instances, such impulsive noises can mimic a same modulation pattern as speech and, hence, can be incorrectly identified as speech by the MSND 121. Further, such impulsive noises can also have sufficient in-band (e.g., in the selected speech-band) energy contents, and can also be incorrectly identified as speech by the FSND 122.

In some implementations, the ID 123 can identify impulsive noise by comparing a value calculated for a frame of the first sequence of energy values with a value calculated for a previous frame of the first sequence of energy values, where each of the frame and the previous frame include a respective plurality of values of the first sequence of energy values. In this example, the ID 123 can further provide the third speech-detection indication based on the comparison, where the third speech-detection indication indicates one of presence of an impulsive noise in the acoustic energy over the first frequency bandwidth and absence of an impulsive noise in the acoustic energy over the first frequency bandwidth.

In some implementations, the combination stage 125 can be configured to receive and combine the first speech-detection indication, the second speech-detection indication and the third speech-detection indication. Based on the combination of the first speech detection indication, the second speech detection indication and the third speech-detection indication, the combination stage can provide an indication of one of a presence of speech in the digitally sampled audio signal and an absence of speech in the digitally sampled audio signal. Example implementations of the (statistic gather and) combination stage 125 are discussed in further detail below.

Figure 3:
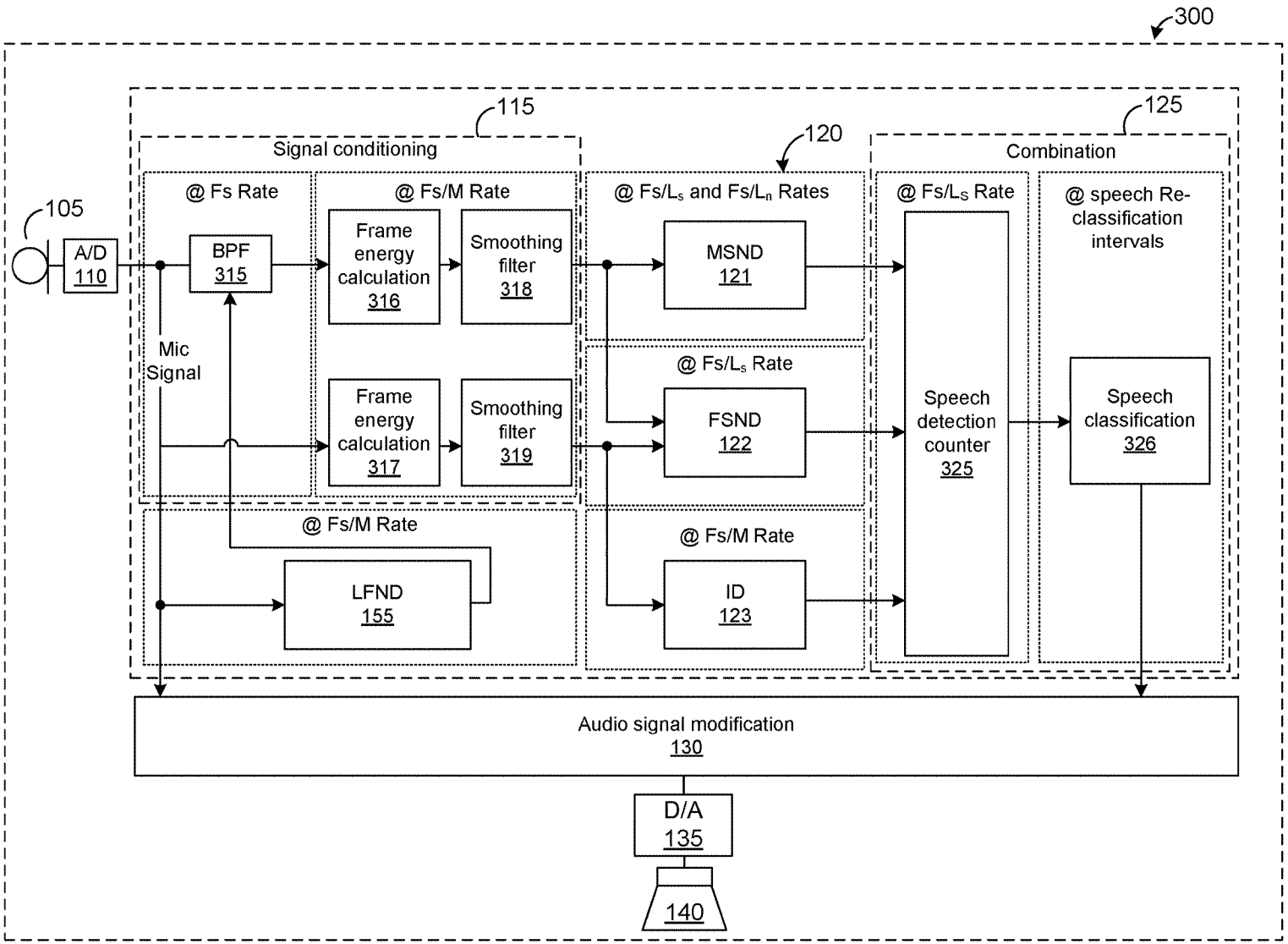
FIG. 3 is a block diagram illustrating an implementation of the apparatus of FIG. 1B.

FIG. 3 is a block diagram illustrating an apparatus 300 that can implement the apparatus 150 of FIG. 1B. In this example, the apparatus 300 includes similar elements as the apparatus 150, and those elements are referenced with like reference numbers. The discussion of the apparatus 300 provides details of a specific implementation. In other implementations, the specific approaches discussed with respect to FIG. 3 may, or may not be used. Additional elements shown for the apparatus 300 in FIG. 3 (as compared to FIG. 1B) are referenced with 300 series reference numbers. In FIG. 3, various operating information, such as frame rates, such as an @Fs Rate for a bandpass filter 315 of the signal conditioning stage 115 are shown. Some details discussed above with respect to FIG. 1B are repeated with respect to FIG. 3 for purposes of clarity and completeness of discussion.

In the example implementation of FIG. 3, an inputs signal to the signal conditioning stage 115 can be a time domain sampled audio signal (received signal) that has been obtained through transformation of the physical sound wave pressures to their equivalent voltage representations by a transducer of the microphone 105, and then passed through an A/D converter 110 to convert the analog voltage representations (analog voltage signal) to digital audio samples. The digitized (received) signal can then passed to the BPF 315, which can implement a filter function of $f[n]$, where the BPF 315 can be configured to retain contents of the received signal where speech energy is expected to be most dominant, while rejecting the remaining portions of the received signal. For instance, in this example, the bandpassed signal can be obtained by the following equation:

$$y_{bp}[n]=(x*f)[n]$$

where x[n] is the input (audio) signal (received signal) sampled a sampling rate of Fs, and $y_{bp}[n]$ is the bandpass filtered signal.

While speech can contain signal energies over a wide frequency range, empirical measurements have shown that bandpass filtering with a range of 300-700 Hz can be effective to reject a wide range of noises while still preserving a speech-dominant part of the energy (acoustic energy) spectrum.

After obtaining the bandpassed filtered signal, the following two averages can be calculated over M samples:

$$E_{bp_inst}[n] = \frac{1}{M}\sum_{i=0}^{M-1} y_{bp}[n-i]^2;\ E_{mic_inst}[n] = \frac{1}{M}\sum_{i=0}^{M-1} x[n-i]^2$$

where M is an integer, and $E_{bp_inst}[n]$ and are $E_{mic_inst}[n]$ are the instantaneous energies at sample n (at the Fs sampling rate). Since the energy estimates may only be calculated and utilized once every M samples, new energy estimates $E[m]_{bp_frame}$ and $E[m]_{mic_frame}$ can be defined as follows:

$$E_{mic_frame}[m]=E_{mic_inst}[mM] \text{ for } m=0, 1, 2, \ldots \text{ and,}$$

$$E_{bp_frame}[m]=E_{bp_{inst}}[mM] \text{ for } m=0, 1, 2, \ldots$$

where m is the time (frame) index at a decimated rate of Fs/M. The frame energy calculations can be performed by blocks 316 and 317 in FIG. 3.

After calculating the above signal energies, signal energy values (e.g., in a sequence of energy values calculated every M samples) the smoothing filters 318 and 319 can exponentially smooth current signal energy values using respective previous frames as follows:

$$E_{bp}[m]=\alpha\times E_{bp}[m-1]+(1-\alpha)\times E_{bp_frame}[m]$$

$$E_{mic}[m]=\alpha\times E_{mic}[m-1]+(1-\alpha)\times E_{mic_frame}[m]$$

where $\alpha$ is a smoothing coefficient, and $E_{bp}[m]$ and $E_{mic}[m]$ are, respectively, smoothed bandpass and mic signal energies. $E_{bp}[m]$ and $E_{mic}[m]$ can then be passed to the detection unit 120 for analysis. An equivalent frame length time for M=0.5 ms has been shown to produce good results in speech classifiers, such as those described herein, while a wider range of 0.1 to 5 ms can be used depending on the computational power restrictions or capabilities of a given implementation. The smoothing coefficient, a, should be chosen such that it tracks the average of the frame energies closely.

In some implementations, depending on the particular hardware architecture, other forms of energy calculations may be performed. For example, if frame energies are not readily available, $E_{bp}[m]$ and $E_{mic}[m]$ may be obtained in continuous form and directly from x[n] and $y_{bp}[n]$ using the following equations:

$$E_{bp}[n]=\alpha\times E_{bp}[n-1]+(1-\alpha)\times x[n]^2$$

$$E_{mic}[n]=\alpha\times E_{mic}[n-1]+(1-\alpha)\times y_{bp}[n]^2$$

In this example, the form of the energy calculations can vary, as long as the $E_{bp}[n]$ and $E_{mic}[n]$ estimates are ultimately sampled at an appropriate sampling rate (e.g., the Fs/M rate in this example) prior to providing the energy calculations (estimates) to the detection units.

As shown in FIG. 3, the input to the MSND 121 is the bandpassed signal energy $E_{bp}[m]$, which can be used by the MSND 121 to monitor a modulation level of the bandpassed signal. In this example, since $E_{bp}[m]$ has been filtered to a narrow bandwidth, where speech is expected to be dominant, a high level of temporal activity can suggest a high likelihood of speech presence. While there are many ways to monitor the modulation level over time, one computationally inexpensive and effective way is to monitor energy modulation excursions using a maximum tracker and a minimum tracker, that are tuned (configured, etc.) to provide, respective speech and noise energy indicators, S and N. In this example, for every frame interval $$\frac{L_s}{M},$$

a speech energy estimate can be obtained by finding a maximum level of $E_{bp}[m]$ since its last update and, for every frame interval, $$\frac{L_n}{M},$$

the noise energy estimate can be obtained by finding a minimum level of $E_{bp}[m]$ since its last update. S and N can be obtained by the MSND 121 using the following equations:

$$S[l_s] = \max\left(E_{bp}\left[l_s\frac{L_s}{M} - i\right]\Big|_{i=0}^{\frac{L_s}{M}-1}\right);\ N[l_n] = \min\left(E_{bp}\left[l_n\frac{L_n}{M} - i\right]\Big|_{i=0}^{\frac{L_n}{M}-1}\right),$$

where $L_s$ and $L_n$ are integer multiples of M.

In this example, since these two calculations are only done over frame lengths of $$\frac{L_s}{M} \text{ and } \frac{L_n}{M}$$

respectively, the name sample rates can be different. Comparisons between speech and noise energy may therefore require synchronization. Mathematically, a closest preceding noise frame, $l_n$ corresponding to speech frame $l_s$ is $l_s$ $$\frac{L_n}{L_s}.$$

One way to avoid synchronization issues is to compare the energy of the current speech frame $S[l_s]$ to the energy of the previous noise frame $N[l_n-1]$, to ensure that the noise estimation process has completed, and the noise estimate is valid. If a divergence threshold, Th, is exceeded, a speech event can be declared by the MSND 121 based on the following equation:

$$SpeechDetected_{MSND}[l_s] = \left(\frac{S[l_s]}{N[l_n - 1]} > Th\right)$$

where, $l_s$ is the speech data index point at the $Fs/L_s$ frame rate and $l_n$ is the noise data index at the $Fs/L_n$ rate. That is, in this example, if the divergence threshold, Th, is exceeded, a speech event, $SpeechDetected_{MSND}[l_s]$, is declared true, otherwise it is declared false. Since Th effectively controls sensitivity of the MSND 121, it should be tuned (determined, established, etc.) with respect to an expected speech activity detection rate in low signal-to-noise (SNR) environments to regularize its tolerance to failure. The range for this threshold can depend on a number of factors, such as a chosen bandwidth of the BPF 315, the filter order of the BPF 315, an expected failure rate of the FSND 122 according to its own thresholds, and/or chosen combination weights in the combination stage 125. Accordingly, the specific threshold for the MSND 121 will depend on the particular implementation.

Further in this example, the choice of $L_s$ and $L_n$ lengths for the MSND 121 can have various implications on the outcome of detecting speech events. For instance, because the MSND 121 can be susceptible to transient noise events, shorter window lengths can be more appropriate in impulsive noise environments, so as to limit impulsive noise contamination to a smaller period of time. Contrarily, longer $L_s$ lengths are less prone to missing speech activity events, such as when a speaker may pause more than usual (or expected) in between words, groups of words, or sentences. Empirical data has shown that window lengths of $L_s$=10 to 100 ms are effective for speech classification. In general, however, the FSND 122's performance can improve with more data points and, since $L_s$, which, in this example is shared with, (also used by) the FSND 122, is inversely related to a number of data point samples per second, a shorter $L_s$ can produce improved performance, but can call for higher computational power.

Contrary to $L_s$, a longer $L_n$ can produce more accurate noise estimate. A suitable time frame for $L_n$, in this example, can be on the order of 3 to 8 seconds. This time period can be selected to ensure that the minimum tracker (discussed above) has sufficient time to find a noise floor in between the speech segments. In the presence of speech, the smoothed energy $E_{bp}[m]$ estimate is biased upward by the speech energy. Accordingly, accurate noise level estimation may only be available between words (speech segments), which can potentially be 3 to 8 seconds apart, depending on a talking speed of a speaker. The minimum tracker in this example implementation should automatically default to a lowest level observed between speech segments.

As shown in FIG. 3, inputs to the FSND 122 in this example are the bandpass filtered signal and the microphone signal energies: $E_{bp}[m]$ and $E_{mic}[m]$. An estimate of a fraction of "out-of-speech-band" energy can be given by the microphone energy divided by the band-passed signal energy which can be calculated every $L_s$ interval to save computation using the following formula:

$$E_r[l_s] = \frac{E_{mic}[l_s]}{E_{bp}[l_s]}$$

where $l_s$ is the frame number at the $Fs/L_s$ rate.

When the energy ratio $E_r[l_s]$ is relatively large, it can indicate the existence of a large amount of out-of-band energy, which can suggest that the received signal is likely not (or likely does not contain) speech. Conversely, when $E_r[l_s]$ is relatively small, it can indicate a small amount of out-of-band energy, which can indicate that the signal is mostly speech or speech-like content. Intermediary values for $E_r[l_s]$ can indicate a mixture of speech or speech-like contents, with out-of-band noise or indeterminate results.

Forming a logical decision for speech detection by the FSND 122 could then be determined (by the FSND 122) using the following relationship:

$$\text{SpeechDetected}_{FSND}[l_s]=(E_r[l_s]<Th)$$

where Th is an energy ratio threshold for the FSND 122.

The energy ratio threshold for the FSND 122 should be set to avoid rejecting mixed speech-and-noise content. A range for this threshold can depend on the chosen bandwidth of the BPF 315, the filter order of the BPF 315, an expected failure rate of the MSND 121 according to its threshold, and chosen combination weights at the combination stage 125. Accordingly, the specific threshold for the FSND 122 will depend on the particular implementation.

As previously discussed, impulsive noise signals can potentially satisfy speech detection criteria of both the MSND 121 and the FSND 122 and lead to false speech detection decisions. While a large portion of the impulse type noise signals can be caught by the FSND 122, a remaining portion may not be readily differentiable from speech for the MSND 121 or the FSND 122. For instance, a set of keys jingling produce impulse-like contents that are largely out-of-band and, thus, would be rejected by the FSND 122. However, a number of impulsive noises, such as noise (sound) generated by hammering a nail through a piece of wood, can contain enough in-band energy to satisfy the FSND 122's threshold (e.g., to indicate the potential presence of speech). Post-ringing (oscillation) produced by such impulsive noises may also satisfy the MSND 121's modulation level threshold (e.g., to indicate the potential presence of speech). The ID 123 can be configured to detect these types of impulsive noises by supplementing operation of the MSND 121 and the FSND 122, to detect such speech-mimicking impulses, that may not otherwise be identified, or may be incorrectly detected as speech.

In this example, the input to the ID 123 is the microphone signal energy $E_{mic}[m]$. Since good rejection performance can be achieved with the FSND 122 and the MSND 121, the ID can be configured to operate as a secondary detector, and computationally efficient ID 123 that can detect impulsive noises can operate using the following relationship:

$$E_i[m] = \frac{E_{mic}[m]}{E_{mic}[m-1]}$$

where $E_i[m]$ is an estimate of mic signal energy variation between two successive M intervals. A higher than usual variation would be suggestive of an impulsive event. Thus, the output of the ID unit can be expressed by the logical state:

$$\text{ImpusleDetected}[m]=(E_i[m]>Th)$$

where Th is a threshold above which the mic signal is considered to contain impulsive noise content.

In this example, unlike the MSND 121 and the FSND 122, the impulse state is not evaluated every $L_s$ intervals, but rather every single interval M, as impulse durations can be as short as a few milliseconds, which can be smaller than the $L_s$ length, and could, therefore, be completely missed otherwise in most cases. The Th threshold for the ID 123 should be set based on the consideration that lower levels could result in triggering impulse detection during speech. Further, a very high level of the Th threshold for the ID 123 could result in missing detection of soft impulses (e.g., impulses of lower energy). The value of Th for the ID 123 can depend on, at least, an impulse detection biasing amount used in the combination stage 124. Accordingly, the specific threshold for the ID 123 will depend on the particular implementation.

While the MSND 121, the FSND 122 and the ID 123 provide respective independent data points on the status of speech presence, in the implementations described herein, the respective data points (speech-detection indications) can be combined to provide more accurate speech classification. A number of factors should be considered regarding the configuration and operation of the combination stage 125. These factors can include speech classification speed, speech detection hysteresis speech detection accuracy in low SNR environments, false speech detection in the absence of speech, speech detection for slower than usual talking speeds, and/or speech classification state fluttering.

One way to combine the individual speech detection decision outputs, satisfy the above factors, and achieve efficient (low) computational power requirements can be accomplished by using a moving speech counter 325, which is referred to herein as a SpeechDetectionCounter, which can operate as described below.

In this example, the SpeechDetectionCounter 325 can be updated using the following logic at each $L_s$ interval:

```
if (SpeechDetected_FSND[l_s] && SpeechDetected_MSND[l_s])
    SpeechDetectionCounter = SpeechDetectionCounter + UpTick
else
    SpeechDetectionCounter = SpeechDetectionCounter − DownTick
end
```

Also, updates to the SpeechDetectionCounter (counter) 125 can be biased to handle slower than usual talking events (e.g., longer pauses in between words), by selecting an UpTick value that is higher than the DownTick value. A ratio of 3 to 1 has been empirically shown to provide a suitable bias level. Using such an UpTick bias can allow for choosing a smaller $L_s$ interval length which, in turn, can reduce a false speech detection rate by limiting impulsive noise contamination to shorter periods, and increasing a number of FSND intervals, thus improving its effectiveness, which can allow for relaxing the threshold of the MSND 121 to improve speech detection in lower SNR environments.

As discussed herein, impulsive type noises can sometimes be falsely detected as speech by the FSND 122 and the MSDN 121. However, in this example the ID 123 can identify such impulsive noises in a majority of instances. False Speech Classification during impulsive noises should be avoided, and the ID 123's decision can be used to enforce that. However, since occasional false impulse triggers can occur during speech, such enforcement should not be done in a binary fashion, or speech classification could be missed in some cases. One computationally efficient way to avoid this issue is to directly bias the SpeechDetectionCounter 325 downward by a certain amount at each M interval when impulses are detected, such as using the following logic:

```
if (ImpulseDetected[m])
    SpeechDetectionCounter = SpeechDetectionCounter −
    ImpulseBiasAdjustment
end
```

Such downward bias can help steering the counter 325 in the correct direction (e.g., in the presence of impulsive noises that mimic speech), while allowing false triggers to occasionally occur, rather than making a binary decision which could result in missing a valid speech classification.

Empirical results have shown that, with a suitable bias adjustment level, it is possible to achieve accurate speech detection (classification) when both speech and impulsive noises occur at the same time (or are present). Such detection is possible in this example, because the UpTick condition is typically triggered at a far higher rate than the impulse bias adjustment rate, even when impulses are happening repetitively. Therefore, with a suitable impulse bias adjustment level, accurate speech detection can be achieved in the presence of impulsive noise. The ImpulseBiasAdjustment value can depend on several factors such as the impulse threshold, the SpeechDetectionCounter 325's threshold (discussed below), the M interval length and sampling frequency. In some implementations, an impulse bias adjustment rate (weight) of 1 to 5 times the UpTick bias (weight) value can be used.

In this example, the SpeechDetectionCounter 325 effectively maintains a running average of the respective speech detection indications of the MSND 121, the FSND 122 and the ID 123 over time. Consequently, when the SpeechDetectionCounter 325 reaches a sufficiently high value, this can be a strong indication that speech is present. The output of the Speech Classifier can, in this example, be formulized as:

$$\text{SpeechClassification}=(\text{SpeechDetectionCounter}>Th)$$

where 1=Speech Classification, 0=No-Speech Classification.

The choice of a threshold above which a Speech Classification stage 326 of the combination stage 125 declares a speech classification can depend on a tolerance for detection delay versus confidence in the speech classification decision. The higher this threshold value is, the higher is the confidence that the speech classification decision is correct. A higher threshold, however, can result in a longer averaging time (e.g., more $L_s$ intervals) than a lower threshold, and, accordingly, a longer speech classification delay. The lower the threshold of the combination stage 125, the lower a number of averaging intervals used to make a speech classification device and, therefore, a faster detection at the cost of a potentially higher false detection rate.

For example, suppose a threshold of 400 is selected for the SpeechDetectionCounter 325 with an $L_s$ interval length of 20 ms. Since the fastest possible way for the SpeechDetectionCounter to grow is by hitting the UpTicks condition in every single $L_s$ interval, at an UpTick rate of 3, the shortest possible (e.g., best case) speech classification time from a quiet start point would be $$\frac{400\times 20}{3}$$

or roughly 2.7 seconds. However, in actual applications, typically not every single $L_s$ interval would trigger an UpTick condition, so the actual speech classification time will most likely be higher than the 2.7 seconds discussed above. Of course, in the event of a lower SNR, a longer averaging period would be used to reach the threshold, which would result in a longer time to speech classification.

The SpeechDetectionCounter 325 can also enforce a continuity requirement. For instance, spoken conversations are usually on the order of several seconds to several minutes, while a large portion of noises do not last beyond a few seconds. By enforcing continuity, such noise events can be filtered out as a results of the SpeechDetectionCounter 325 maintaining a running average as discussed herein, and the inherent continuity requirement of that process, regardless of the FSND 122's, the MSND 121's and the ID 123's individual speech-detection decisions.

To provide hysteresis, that is, to enforce staying in a speech classification state longer if speech has been occurring for a period of time, the SpeechDetectionCounter 325 can, once again, be used almost for free (computationally). This can be done by capping the SpeechDetectionCounter 325 to an appropriate value: the higher the capping value, the higher the SpeechDetectionCounter 325 can grow, and therefore, the longer it will take for it to drop and cross the No-Speech threshold when speech goes away. On the contrary, a lower capping value would not allow SpeechDetectionCounter 325 to grow much in the presence of extended periods of speech, and therefore, it will need a shorter time to reach the Speech Classification threshold in its downward direction when speech goes away.

Going back to the previous example, if an 8 second period is to occur before exiting a previously determined speech classification that has been going on for a while (e.g., to handle, for example, cases where one or more of the speaking parties repeatedly takes a few seconds to think before responding back), a cap of 800 could be used for the SpeechDetectionCounter 325. In this example, starting with the SpeechDetectionCounter 325 at a value of 800, using a DownTick=1, and assuming no impulse events occur during this period, with $L_s$=20 ms, it would take exactly 8 seconds for the counter to drop below the previously mentioned threshold of 400, causing the classification of the Speech Classification stage 326 to change from Speech to No-Speech. During this 8 second period of time, if a speaker starts speaking, the SpeechDetectionCounter 325 would increase and cap at 800 again. It is noted that the SpeechDetectionCounter 325 should also be capped at 0 on the downward direction as well, to prevent the SpeechDetectionCounter 325 from having a negative value.

In this example, at each SpeechDetectionCounter 325 update event, a value of the SpeechDetectionCounter 325 can be determine based on the following:

$$\text{SpeechDetectionCounter}=\max(\text{SpeechDetectionCounter},0)$$

$$\text{SpeechDetectionCounter}=\min(\text{SpeechDetectionCounter},800)$$

Rapid classification state fluttering between Speech and No-Speech is not likely in this example, but is possible. Since the SpeechDetectionCounter 325 must either go up or down at any given update, as long as the Speech and No-Speech detections are not exactly split at 50 percent (e.g., without taking UpTick bias into account), in most cases the SpeechDetectionCounter 325 will eventually either max out at an upper cap value, or will go to a lower cap value of, e.g., 0. However, it is possible that the counter 325 may flip back and forth around the threshold value a few times on its way up or down. This could, of course, cause classification fluttering. Such fluttering can be countered using a simple provision of enforcing a blackout period, such that a minimum amount of time must go by before another classification (e.g., a change in speech classification) can be made. For example, a 10 second blackout period could be applied. Since 10 seconds would be a rather long time for the SpeechDetectionCounter 325 to consistently hover around a Speech Classification threshold, this approach can prevent repetitive reclassifications in most cases.

One environment in which accurate speech classification can be challenging, is a car noise (or vehicle noise) environment, where noise levels are typically much higher (e.g., due to an engine, poor road noise insulation due to age, a fan, driving on an uneven road, etc.) than many environments. In a car noise environment, low frequency noise can potentially overwhelm speech energy in the 300-700 Hz bandwidth used in the signal conditioning stage 115, as discussed herein. Accordingly, speech detection may be difficult, or no longer be possible. To mitigate this issue, the passband (frequency range) can be moved to a higher range, where less car (vehicle) noise contamination is present, but to a frequency range where there is still sufficient speech contents for accurate speech detection. Empirical data, through road tests with different cars, has shown that a passband of 900-5000 Hz allows for accurate speech detection in the presence of vehicle noise, as well as effective vehicle noise rejection (e.g., prevent misclassifications of noise as speech) in the absence of speech. This higher frequency passband should, however, not be used universally, as it could introduce susceptibility to other types of noise in non-car environments.

As discussed briefly above, the LFND 155 can be used to determine when car or vehicle noise is present and dynamically switch the passband from 300-700 Hz to 900-5000 Hz and back as required (e.g., by sending a feedback signal to the signal conditioning stage 115). In this example, the input to the LFND 155 unit is the digitized microphone signal. The digitized microphone signal can then be split into two signals, one that goes through a sharp ultra low-pass frequency filter (ULFF) set with a cut-off frequency of 200 Hz, and another that goes through a sharp bandpass low frequency filter (LFF) with a passband of 200-400 Hz.

The energies of these two signals can be tracked in a similar way as the $E_{mic}[m]$ and $E_{bp}[m]$ energies. The resulting signals, $E_{ulf}[m]$ and $E_{lf}[m]$ represent, respectively, ultra-low frequency and low frequency energy estimates. Empirical data consistently demonstrates that car noise possesses significant ultra-low frequency energy due to physical vibrations produced by the engine and the suspension. Since the amount of ultra-low frequency energy (<200 Hz) is typically higher than the low-frequency energy (200 Hz to 400 Hz) in a car noise environment, a ratio comparison of $E_{ulf}[m]$ to $E_{lf}[m]$ provides a convenient and computationally efficient way to determine whether car noise is present, using the following.

$$E_{lfr}[m] = \frac{E_{ulf}[m]}{E_{lf}[m]}$$

and $$E_{lfr}[m] > Th_{lf_ratio}$$

where $Th_{lf_ratio}$ is a threshold above which car noise is considered to be present.

Figure 5:
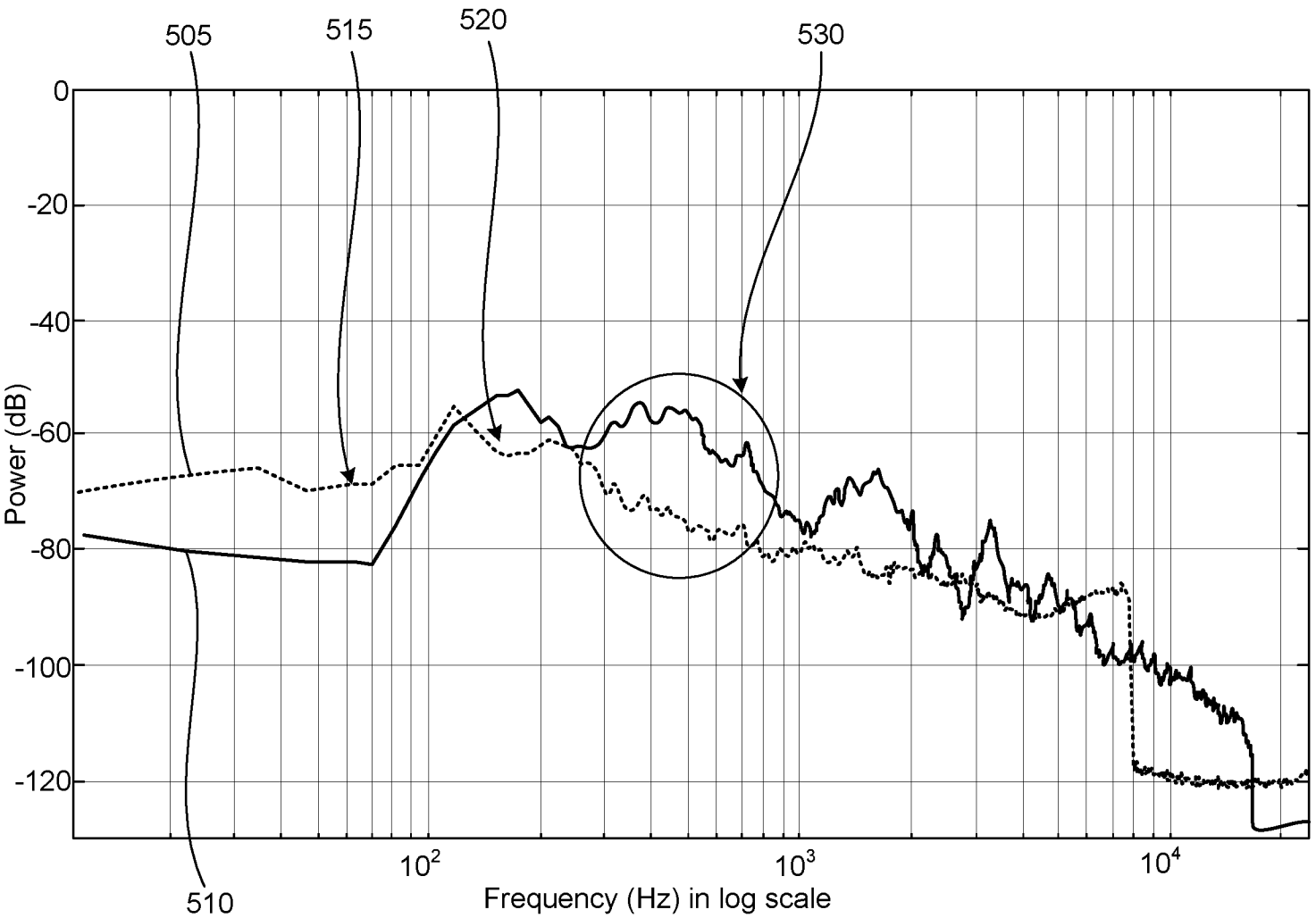
FIGS. 5 and 6 are graphs illustrating operation of a low-frequency noise detector, such as in the implementations of FIGS. 3 and 4.
Figure 6:
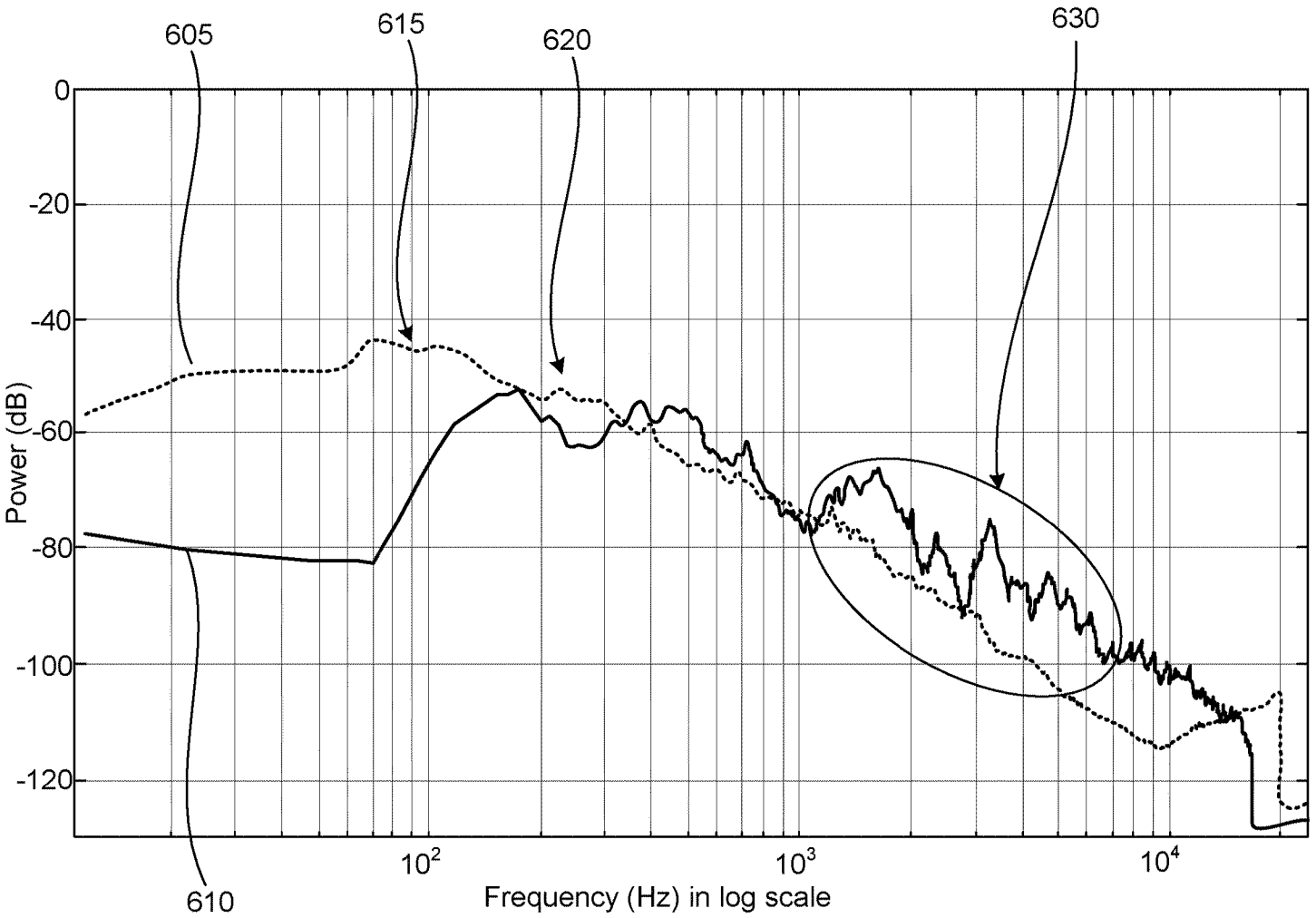

A logical state of this comparison can then be tracked over several seconds. When consistent presence of car noise is detected, a feedback signal can be sent from the LFND 155 to the signal conditioning stage 115 to, in this example, update the passband range from a frequency bandwidth of 300-700 Hz to a frequency bandwidth of 900-5000 Hz. Similarly, upon consistent absence of car noise, a feedback signal can sent from the LFND 155 to the signal conditioning stage to restore the original passband range (e.g., 300-700 Hz). FIGS. 5 and 6 demonstrate examples of these conditions.

Certain noises such as household air conditioning units can produce the same frequency response shape as a vehicle noise environment, thus satisfying the $E_{lfr}[m]>Th_{lf_ratio}$ condition, but may not reach a sufficiently high energy level to dominate speech in a passband region of 300-700 Hz. To mitigate a potential unnecessary passband range switch, a second check may be added based on an absolute level of $E_{ulf}[m]$, to ensure that a passband update only occurs when there is significant amount (above a threshold energy level) of low frequency noise present. The final output of LFND unit can then be determined as:

$$\text{LFNoiseDetected}_{LFND}[m]=(E_{lfr}[m]>Th_{lf_ratio})\ \&\&\ (E_{ulf}[m]>Th_{level})$$

Through this rather computationally inexpensive process, accurate speech detection can be achieved in the presence of (ultra) low frequency noise, such as can occur in a car, plane or factory environment. In some implementations, particularly for car noise detection, a pitch detector may be included in the apparatus 300 as a confirmation unit, where the pitch detector is configured to look for a fundamental frequency and its harmonics in the sub 300 Hz range.

The use of the output of a speech classifier depends on the particular application. One use of Speech Classification is to return system parameters that better suit a speech environment. For example, in the case of a hearing aid, an existing noise reduction algorithm in the signal path may be tuned to heavily filter out noise which could, at times, reduce speech intelligibility, if operating. Upon classifying speech, the noise reduction algorithm can be adjusted to be less aggressive and, as a result, improve speech cue perception for hearing impaired patients. Thus, a Speech Classifier classification state can impact a resulting physical sound wave pressure produced by a corresponding audio output device 140 included in a hearing aid of a user.

Figure 4:
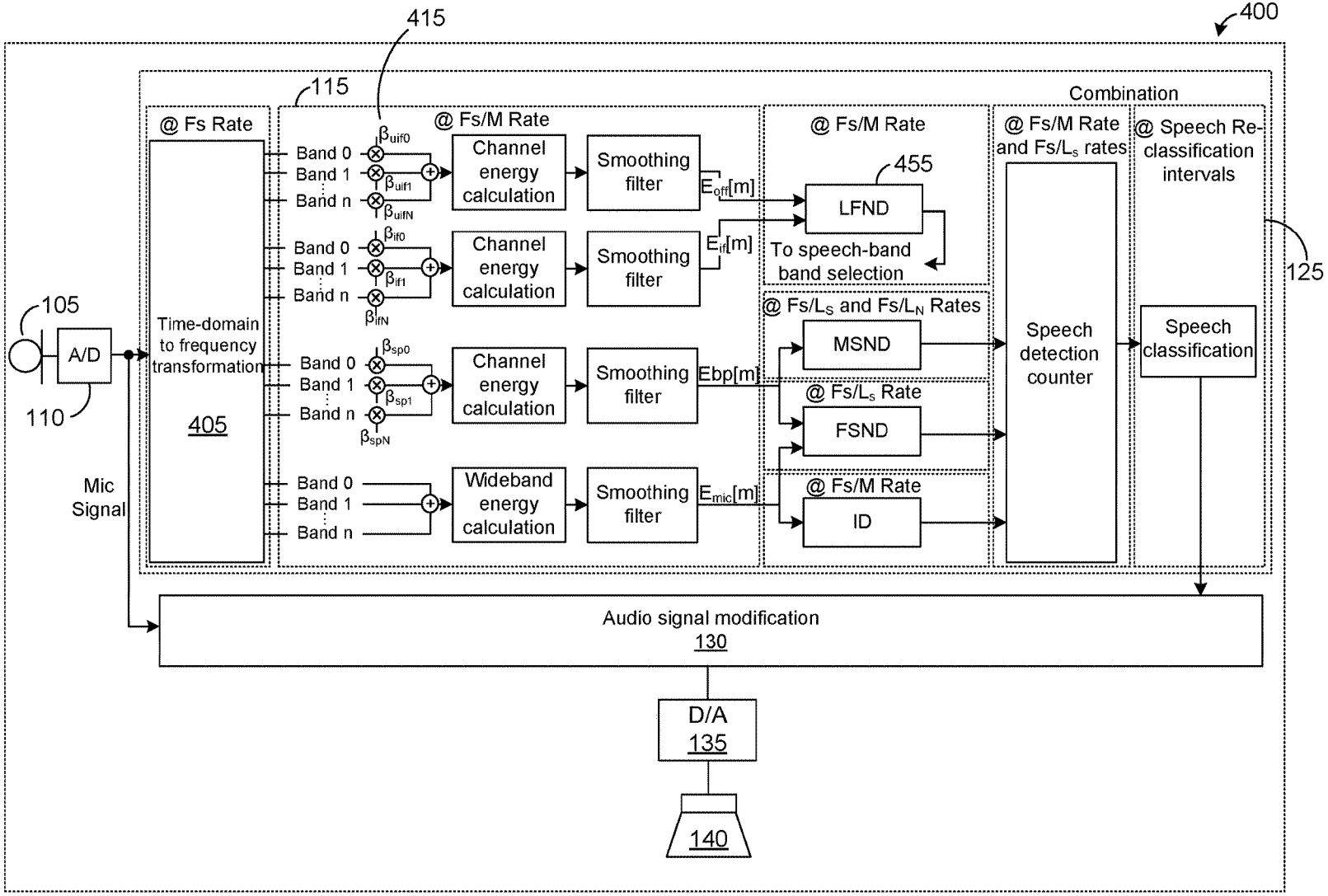
FIG. 4 is a block diagram illustrating another implementation of the apparatus of FIG. 1B.

FIG. 4 is a block diagram illustrating an apparatus 400 that can implement the apparatus 150 of FIG. 1B. The apparatus 400 includes a number of similar elements as the apparatus 300, which can operate in similar fashion as the elements of the apparatus 300. Accordingly, for purposes of brevity, those elements are not discussed in detail again here with respect to FIG. 4. Comparing the apparatus 400 of FIG. 4 with the apparatus 300 of FIG. 3, the apparatus 400 includes a frequency-domain based speech classifier, as opposed to the time-based speech classifier included in the apparatus 300.

In order to implement the apparatus 400, appropriate hardware should be used to implement the frequency-based speech classifier. In a frequency domain implementation, the $E_{mic}[m]$, $E_{bp}[m]$, $E_{ulf}[m]$ and $E_{lf}[m]$ estimates can be obtained directly from fast-Fourier-transform (FFT) bins or, in the case of a filter-bank, sub-band channels 415 that map to the passband ranges of the corresponding time-domain filters in an equivalent time-domain implementation. such as a BPF, an ULFF and a LFF. As noted above, operations of the MSND, the FSND, the ID, the LFND and the combination stage would largely remain the same. Time-constants and thresholds should, however, be adjusted according to an effective filter-bank sub-band sampling rate.

In some implementations, a frequency-based speech classifier could include over-sampled weighted overlap-add (WOLA) filter-banks. In such an implementation a time-domain to frequency-domain transformation (analysis) block 405 in the apparatus 400 could be implemented using a WOLA filterbank.

In the apparatus 400, the input to the signal conditioning stage 115 is frequency domain sub-band magnitude data X[m, k] (phase is ignored), where m is the frame index (e.g., a filterbank's short-time window index), k is a band index from 0 to N−1 and N is a number of frequency sub-bands. In some implementations, it would be convenient to choose a filterbank window of size M or the base frame size, as described previously. Moreover, a suitable sub-band bandwidth choice for the filterbank to sufficiently satisfy the LFND, MSND and FSND module requirements could be 100 or 200 Hz, but other similar bandwidths can also be utilized with some adjustments. At every frame m, $E_{mic_frame}$[m] can be calculated as:

$$E_{mic_frame}[m] = \frac{1}{N}\sum_{k=0}^{N-1} X[m, k]^2$$

and $E_{bp_frame}$ can be calculated as:

$$E_{bp_frame}[m] = \frac{1}{N}\sum_{k=0}^{N-1} \beta_{sp}[k].X[m, k]^2$$

where $\beta_{sp}$ is a set of weight factors chosen such that a bandpass function, similar to the described time-domain implementation, can be achieved, namely between 300 to 700 Hz. A suitable choice may be a set of weight factors that map to 40 dB per decade roll-off for frequencies less than 300 Hz and 20 dB per decade for frequencies above 700 Hz. When a LFND 455 is present, the $\beta_{sp}$[k] weight factors may be dynamically updated by the LFND 455 (e.g., speech-band band selection feedback in FIG. 4) in real-time to map to a frequency range of 900-5000 Hz, such as per described in the time-domain section.

The $E_{mic}$[m] and $E_{bp}$[m] estimates can then be obtained in the same manner as in the time-domain implementation as:

$$E_{mic}[m]=\alpha\times E_{mic}[m-1]+(1-\alpha)\times E_{mic_frame}[m]$$

$$E_{bp}[m]=\alpha\times E_{bp}[m-1]+(1-\alpha)\times E_{bp_frame}[m]$$

where α, the smoothing coefficient, may be chosen appropriately according to the filterbank characteristics to achieve a same desired averaging. The estimates can then be passed to the MSND, FSND and ID detection units where the remaining operations can follow exactly as before, such as discussed with respect to FIG. 3.

$E_{ulf}$[m] and $E_{lf}$[m] estimates for the LFND unit of the apparatus 400 can also be calculated in a similar fashion as discussed for the apparatus 300, using:

$$E_{ulf}[m] = \frac{1}{N}\sum_{k=0}^{N-1} \beta_{ulf}[k].X[m, k]^2$$

and, $$E_{lf}[m] = \frac{1}{N}\sum_{k=0}^{N-1} \beta_{lf}[k].X[m, k]^2$$

where $\beta_{ulf}$ is the set of coefficients mapping to 0 to 200 Hz and $\beta_{lf}$ is the set mapping to 200 to 400 Hz. Since these filters should, ideally, be as sharp as possible, a choice of 0 for all the coefficients outside of the bandpass region can be appropriate. The calculations can then be simplified to:

$$E_{ulf}[m] = \frac{1}{N}\sum_{k=0}^{ULF_U} X[m, k]^2$$

and, $$E_{lf}[m] = \frac{1}{N}\sum_{k=LF_L}^{LF_U} X[m, k]^2$$

where band numbers, 0: ULF_U, correspond to the low-pass range of the ultra-low frequency filter and band numbers, LF_L: LF_U, correspond to the band-pass range of the low frequency filter. In the examples described herein, these ranges can be 0:200 and 200:400 respectively. This simplification reduces computational complexity and, as a result, power consumption. The $E_{ulf}$[m] and $E_{lf}$[m] estimates can then be passed to the LFND, where the remaining operations can follow exactly as the time-domain implementation.

FIGS. 5 and 6 are graphs illustrating operation of a low-frequency noise detector, such as in the implementations of FIGS. 3 and 4. FIG. 5 includes a graph 500 that corresponds with a typical room environment, such as in a residential location. In FIG. 5, the trace 505 corresponds with room noise and the trace 510 corresponds with speech. The markers 515 and 520 in FIG. 5 illustrate a low Ultra-Low Frequency to Low Frequency Ratio $E_{lfr}$, demonstrating absence of significant low-frequency noise (e.g. such as associate with a car noise environment). As shown by the marker 530, a passband range of 300-700 Hz is assigned, such as discussed with respect to FIG. 3. The room noise 505 and speech 510 signals have been obtained separately and have been overlaid after for demonstration purposes.

FIG. 6 includes a graph 600 that corresponds with a car noise environment, such in a residential location. In FIG. 6, the trace 605 corresponds with car noise and the trace 610 corresponds with speech. The markers 615 and 620 in FIG. 6 illustrate a high Ultra-Low Frequency to Low Frequency Ratio $E_{lfr}$, demonstrating presence of significant low-frequency noise. As shown by the marker 630, a passband range of 900-5000 Hz is assigned, such as discussed with respect to FIG. 3. Similar to the graph 500 in FIG. 5, the room noise 605 and speech 610 signals have been obtained separately and have been overlaid after for demonstration purposes.

Figure 7A:
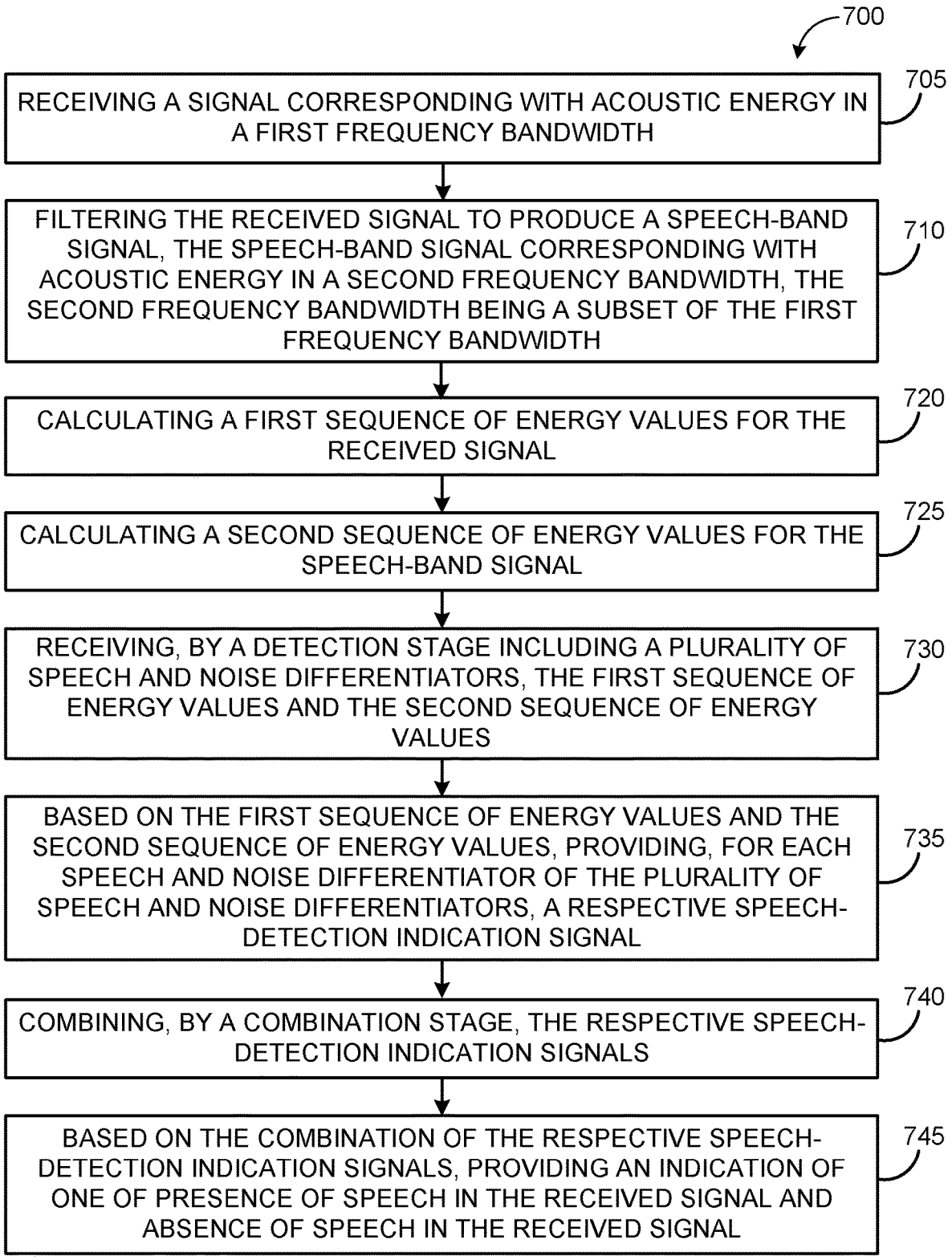
FIG. 7A is a flowchart illustrating a method for speech classification (speech detection) in an audio signal.

FIG. 7A is a flowchart illustrating a method 700 for speech classification (speech detection) in an audio signal. In some implementations, the method 700 can be implemented using the apparatus described herein, such as the apparatus 300 of FIG. 3. Accordingly, FIG. 7A will be described with further reference to FIG. 3. In some implementations, the method 700 can be implemented in apparatus having other configurations, and/or including other speech classifiers.

As shown in FIG. 7A, at block 705, the method 700 includes receiving, by an audio processing circuit (such as by the signal conditioning stage 115), a signal corresponding with acoustic energy in a first frequency bandwidth. At block 710, the method 700 includes, filtering the received signal to produce a speech-band signal (such as with the BPF 215). The speech-band signal, as discussed herein, can correspond with acoustic energy in a second frequency bandwidth (e.g., a speech-dominated frequency band, a speech-band, etc.), where the second frequency bandwidth is a subset of the first frequency bandwidth.

At block 720, the method 700 includes calculating (e.g., by the signal conditioning stage 115) a first sequence of energy values for the received signal and, at block 725 calculating (e.g., by the signal conditioning stage 115) a second sequence of energy values for the speech-band signal. At block 730, the method 700 includes receiving (e.g., by the detection stage 120), the first sequence of energy values and the second sequence of energy values. At block 735, the method 700 includes, based on the first sequence of energy values and the second sequence of energy values, providing, for each speech and noise differentiator of the detection stage 120, a respective speech-detection indication signal. The method 700, at block 740, includes combining (e.g., by the combination stage 125) the respective speech-detection indication signals and, at block 745, includes, based on the combination of the respective speech-detection indication signals, providing (e.g., by the combination stage 125) an indication of one of presence of speech in the received signal and absence of speech in the received signal.

Figure 7B:
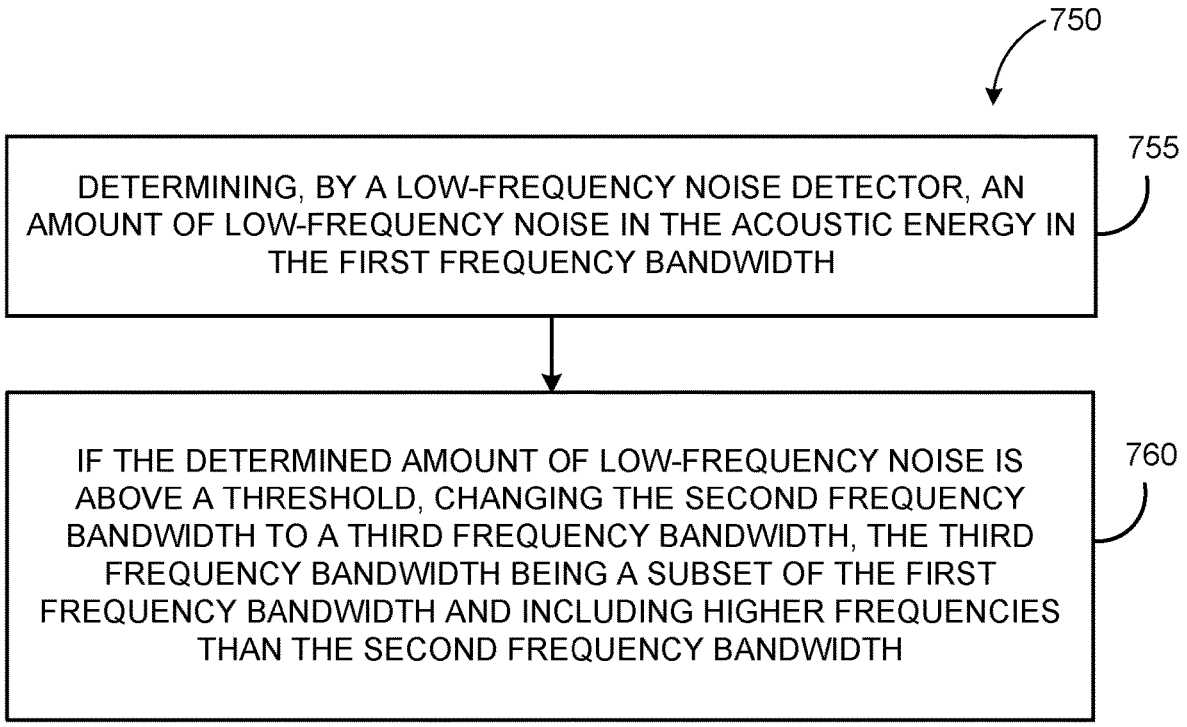
FIG. 7B is a flowchart illustrating a method for speech classification (speech detection) in an audio signal that can be implemented in conjunction with the method of FIG. 7A.

FIG. 7B is a flowchart illustrating a method for speech classification (speech detection) in an audio signal that can be implemented in conjunction with the method of FIG. 7A. As with the method 700, in some implementations, the method 750 can be implemented using the apparatus described herein, such as the apparatus 300 of FIG. 3. Accordingly, FIG. 7B will also be described with further reference to FIG. 3. However, it is noted that, in some implementations, the method 750 can also be implemented in apparatus having other configurations, and/or including other speech classifiers.

At block 755, continuing from the method 700, the method 750 includes determining (e.g., by the LFND 155) an amount of low-frequency noise in the acoustic energy in the first frequency bandwidth. At block 760, if the determined amount of low-frequency noise is above a threshold, the method 750 further includes changing (e.g., based on a feedback signal to the signal conditioning stage 115 from the LFND 155) the second frequency bandwidth to a third frequency bandwidth. In the method 700, the third frequency bandwidth can be a subset of the first frequency bandwidth and include higher frequencies than the second frequency bandwidth. That is, at block 760, a speech-band bandwidth can be changed (e.g., to higher frequencies) to compensate for (eliminate, reduce the effects of, etc.) low-frequency noise and ultra-low frequency noise in performing speech classification.

It will be understood that, in the foregoing description, when an element is referred to as being on, connected to, electrically connected to, coupled to, or electrically coupled to another element, it may be directly on, connected or coupled to the other element, or one or more intervening elements may be present. In contrast, when an element is referred to as being directly on, directly connected to or directly coupled to another element, there are no intervening elements present. Although the terms directly on, directly connected to, or directly coupled to may not be used throughout the detailed description, elements that are shown as being directly on, directly connected or directly coupled can be referred to as such. The claims of the application, if any, may be amended to recite exemplary relationships described in the specification and/or shown in the figures.

As used in this specification, a singular form may, unless definitely indicating a particular case in terms of the context, include a plural form. Spatially relative terms (e.g., over, above, upper, under, beneath, below, lower, and so forth) are intended to encompass different orientations of the device in use or operation in addition to the orientation depicted in the figures. In some implementations, the relative terms above and below can, respectively, include vertically above and vertically below. In some implementations, the term adjacent can include laterally adjacent to or horizontally adjacent to.

Implementations of the various techniques described herein may be implemented in (e.g., included in) digital electronic circuitry, or in computer hardware, firmware, software, or in combinations of them. Portions of methods also may be performed by, and an apparatus may be implemented as, special purpose logic circuitry, e.g., an FPGA (field programmable gate array), a programmable circuit or chipset, and/or an ASIC (application specific integrated circuit).

Some implementations may be implemented using various semiconductor processing and/or packaging techniques. Some implementations may be implemented using various types of semiconductor processing techniques associated with semiconductor substrates including, but not limited to, for example, Silicon (Si), Gallium Arsenide (GaAs), Gallium Nitride (GaN), Silicon Carbide (SiC) and/or so forth.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components and/or features of the different implementations described.

What is claimed is:

1. An apparatus for detecting speech, the apparatus comprising:

a signal conditioning stage configured to:

receive a signal corresponding with acoustic energy in a first frequency bandwidth;

filter the received signal to produce a speech-band signal, the speech-band signal corresponding with acoustic energy in a second frequency bandwidth, the second frequency bandwidth being a first subset of the first frequency bandwidth;

calculate a first sequence of energy values for the received signal; and calculate a second sequence of energy values for the speech-band signal;

a detection stage including a plurality of speech and noise differentiators, the detection stage being configured to:

receive the first sequence of energy values and the second sequence of energy values; and based on the first sequence of energy values and the second sequence of energy values, provide, for each speech and noise differentiator of the plurality of speech and noise differentiators, a respective speech-detection indication signal; and a combination stage configured to:

combine the respective speech-detection indication signals; and based on the combination of the respective speech-detection indication signals, provide an indication of one of presence of speech in the received signal and absence of speech in the received signal.

2. The apparatus of claim 1, further comprising an analog-to-digital converter configured to:

receive an analog voltage signal corresponding with the acoustic energy over the first frequency bandwidth, the analog voltage signal being produced by a transducer of a microphone;

digitally sample the analog voltage signal; and provide the digitally sampled analog voltage signal to the signal conditioning stage as the received signal.

3. The apparatus of claim 1, wherein:

the first sequence of energy values is a first sequence of exponentially smoothed energy values; and the second sequence of energy values is a second sequence of exponentially smoothed energy values.

4. The apparatus of claim 1, wherein filtering the received signal to produce the speech-band signal includes applying respective weights to a plurality of frequency sub-bands of a filterbank.

5. The apparatus of claim 1, wherein the plurality of speech and noise differentiators includes a modulation-based speech and noise differentiator configured to:

calculate a speech energy estimate for the speech-band signal based on the second sequence of energy values;

calculate a noise energy estimate for the speech-band signal based on the second sequence of energy values; and provide its respective speech-detection indication based on a comparison of the speech energy estimate with the noise energy estimate.

6. The apparatus of claim 5, wherein:

the speech energy estimate is calculated over a first time period; and the noise energy estimate is calculated over a second time period, the second time period being greater than the first time period.

7. The apparatus of claim 1, wherein the plurality of speech and noise differentiators includes a frequency-based speech and noise differentiator configured to:

compare the first sequence of energy values with the second sequence of energy values; and provide its respective speech-detection indication based on the comparison.

8. The apparatus of claim 7, wherein comparing the first sequence of energy values with the second sequence of energy values includes determining a ratio between energy values of the first sequence of energy values and corresponding energy values of the second sequence of energy values.

9. The apparatus of claim 1, wherein the plurality of speech and noise differentiators includes an impulse detector configured to:

compare a value calculated for a frame of the first sequence of energy values with a value calculated for a previous frame of the first sequence of energy values, each of the frame and the previous frame including a respective plurality of values of the first sequence of energy values; and provide its respective speech-detection indication based on the comparison, the respective speech-detection indication of the impulse detector indicating one of:

presence of an impulsive noise in the acoustic energy over the first frequency bandwidth; and absence of an impulsive noise in the acoustic energy over the first frequency bandwidth.

10. The apparatus of claim 9, wherein comparing the value calculated for the frame of the first sequence of energy values with the value calculated for the previous frame of the first sequence of energy values includes calculating a first order differentiation of the received signal energy.

11. The apparatus of claim 1, wherein:

combining the respective speech-detection indication signals by the combination stage includes maintaining a weighted rolling counter value between a lower limit and an upper limit, the weighted rolling counter value being based on the respective speech-detection indication signals;

the combination stage is configured to indicate the presence of speech in the received signal if the weighted rolling counter value is above a threshold value; and the combination stage is configured to indicate the absence of speech in the received signal if the weighted rolling counter value is below the threshold value.

12. The apparatus of claim 1, further comprising a low-frequency noise detector configured to:

determine, based on the received signal, an amount of low-frequency noise energy in the acoustic energy in the first frequency bandwidth; and if the determined amount of low-frequency noise energy is above a threshold, provide a feedback signal to the signal conditioning stage, the signal conditioning stage being configured to, in response to the feedback signal, change the second frequency bandwidth to a third frequency bandwidth, the third frequency bandwidth being a second subset of the first frequency bandwidth and including higher frequencies than the second frequency bandwidth.

13. The apparatus of claim 12, wherein the low-frequency noise detector is further configured to:

determine, based on the received signal, that the amount of low-frequency noise energy in the acoustic energy over the first frequency bandwidth has decreased from being above the threshold to being below the threshold; and change the feedback signal to indicate that the amount of low-frequency noise energy in the acoustic energy over the first frequency bandwidth is below the threshold, the signal conditioning stage being configured to, in response to the change in the feedback signal, change the third frequency bandwidth to the second frequency bandwidth.

14. An apparatus for speech detection, the apparatus comprising:

a signal conditioning stage configured to:

receive a digitally sampled audio signal;

calculate a first sequence of energy values for the digitally sampled audio signal; and calculate a second sequence of energy values for the digitally sampled audio signal, the second sequence of energy values corresponding with a speech-band of the digitally sampled audio signal;

a detection stage including:

a modulation-based speech and noise differentiator configured to provide a first speech-detection indication based on temporal modulation activity in the speech-band;

a frequency-based speech and noise differentiator configured to provide a second speech-detection indication based on a comparison of the first sequence of energy values with the second sequence of energy values; and an impulse detector configured to provide a third speech-detection indication based on a first order differentiation of the digitally sampled audio signal; and a combination stage configured to:

combine the first speech-detection indication, the second speech-detection indication and the third speech-detection indication; and based on the combination of the first speech detection indication, the second speech detection indication and the third speech-detection indication, provide an indication of one of a presence of speech in the digitally sampled audio signal and an absence of speech in the digitally sampled audio signal.

15. The apparatus of claim 14, wherein:

the first sequence of energy values is a first sequence of exponentially smoothed energy values; and the second sequence of energy values is a second sequence of exponentially smoothed energy values.

16. The apparatus of claim 14, wherein the modulation-based speech and noise differentiator is configured to:

calculate a speech energy estimate based on the second sequence of energy values;

calculate a noise energy estimate based on the second sequence of energy values; and provide the first speech-detection indication based on a comparison of the speech energy estimate with the noise energy estimate.

17. The apparatus of claim 16, wherein:

the speech energy estimate is calculated over a first time period; and the noise energy estimate is calculated over a second time period, the second time period being greater than the first time period.

18. The apparatus of claim 14, wherein comparing, by the frequency-based speech and noise differentiator, the first sequence of energy values with the second sequence of energy values includes determining a ratio between energy values of the first sequence of energy values and corresponding energy values of the second sequence of energy values.

19. The apparatus of claim 14, wherein the impulse detector is further configured to determine the first order differentiation by comparing a value calculated for a frame of the first sequence of energy values with a value calculated for a previous frame of the first sequence of energy values, each of the frame and the previous frame including a respective plurality of values of the first sequence of energy values, the third speech-detection indication of the impulse detector indicating one of:

presence of an impulsive noise in the digitally sampled audio signal; and absence of an impulsive noise in the digitally sampled audio signal.

20. The apparatus of claim 14, wherein:

combining the first speech-detection indication, the second speech-detection indication and the third speech-detection indication by the combination stage includes maintaining a weighted rolling counter value between a lower limit and an upper limit, the weighted rolling counter value being based on the first speech-detection indication, the second speech-detection indication and the third speech-detection indication;

the combination stage is configured to indicate the presence of speech in digitally sampled audio signal if the weighted rolling counter value is above a threshold value; and the combination stage is configured to indicate the absence of speech in the digitally sampled audio signal if the weighted rolling counter value is below the threshold value.

21. The apparatus of claim 14, further comprising a low-frequency noise detector configured to:

determine an amount of low-frequency noise energy in the digitally sampled audio signal; and if the determined amount of low-frequency noise energy is above a threshold, provide a feedback signal to the signal conditioning stage, the signal conditioning stage being configured to, in response to the feedback signal, change a frequency range of the speech-band from a first frequency bandwidth to a second frequency bandwidth, the second frequency bandwidth including higher frequencies than the first frequency bandwidth, the first frequency bandwidth and the second frequency bandwidth being respective subsets of a frequency bandwidth of the digitally sampled audio signal.

22. The apparatus of claim 21, wherein the low-frequency noise detector is further configured to:

determine that the amount of low-frequency noise energy in the digitally sampled audio signal has decreased from being above the threshold to being below the threshold; and change the feedback signal to indicate that the amount of low-frequency noise energy in the digitally sampled audio signal is below the threshold, the signal conditioning stage being configured to, in response to the change in the feedback signal, change the frequency bandwidth of the speech-band from the second frequency bandwidth to the first frequency bandwidth.

23. A method for speech detection, the method comprising:

receiving, by an audio processing circuit, a signal corresponding with acoustic energy in a first frequency bandwidth;

filtering the received signal to produce a speech-band signal, the speech-band signal corresponding with acoustic energy in a second frequency bandwidth, the second frequency bandwidth being a subset of the first frequency bandwidth;

calculating a first sequence of energy values for the received signal;

calculating a second sequence of energy values for the speech-band signal;

receiving, by a detection stage including a plurality of speech and noise differentiators, the first sequence of energy values and the second sequence of energy values;

based on the first sequence of energy values and the second sequence of energy values, providing, for each speech and noise differentiator of the plurality of speech and noise differentiators, a respective speech-detection indication signal;

combining, by a combination stage, the respective speech-detection indication signals; and based on the combination of the respective speech-detection indication signals, providing an indication of one of presence of speech in the received signal and absence of speech in the received signal.

24. The method of claim 23, further comprising:

determining, by a low-frequency noise detector, an amount of low-frequency noise in the acoustic energy in the first frequency bandwidth;

if the determined amount of low-frequency noise is above a threshold, changing the second frequency bandwidth to a third frequency bandwidth, the third frequency bandwidth being a subset of the first frequency bandwidth and including higher frequencies than the second frequency bandwidth.

25. The method of claim 23, wherein:

the first sequence of energy values is a first sequence of exponentially smoothed energy values; and the second sequence of energy values is a second sequence of exponentially smoothed energy values.

* * * * *